US007147292B2

(12) United States Patent
Lee et al.

(10) Patent No.: US 7,147,292 B2
(45) Date of Patent: Dec. 12, 2006

(54) OBTURATOR FOR REFRIGERATOR

(75) Inventors: Myung Ryul Lee, Seongnam-si (KR); Seong Jae Kim, Incheon-si (KR); Young Ju Ha, Busan-si (KR); Ching Ho Lee, Busan-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/232,571

(22) Filed: Sep. 3, 2002

(65) Prior Publication Data

US 2003/0222553 A1 Dec. 4, 2003

(30) Foreign Application Priority Data

Jun. 4, 2002 (KR) ..... 2002-31355
Jun. 4, 2002 (KR) ..... 2002-31356

(51) Int. Cl.
*E06B 7/16* (2006.01)

(52) U.S. Cl. ..... 312/296; 312/405; 49/492.1

(58) Field of Classification Search ..... 312/405, 312/326, 327, 328, 329, 296; 49/489.1, 475.1, 49/498.1, 492.1
See application file for complete search history.

(56) References Cited

U.S. PATENT DOCUMENTS 3,078,134 A * 2/1963 Haynes, Jr. ..... 312/296
4,617,759 A * 10/1986 Pasqualini et al. ..... 49/478.1
4,644,698 A * 2/1987 Gerdes et al. ..... 49/478.1
5,289,657 A * 3/1994 Kiel ..... 49/478.1
5,476,318 A * 12/1995 Yingst et al. ..... 312/405
5,533,311 A * 7/1996 Tirrell et al. ..... 52/309.9
5,551,192 A * 9/1996 Avendano et al. ..... 49/484.1
5,916,076 A * 6/1999 Cittadini et al. ..... 49/492.1
6,227,634 B1 * 5/2001 Cittadini et al. ..... 312/296
6,526,698 B1 * 3/2003 Park et al. ..... 49/489.1
6,804,915 B1 * 10/2004 Holmqvist ..... 49/492.1

FOREIGN PATENT DOCUMENTS

CN 86203232 U 4/1987
CN 2418233 Y 2/2001

* cited by examiner

*Primary Examiner*—Janet M. Wilkens
(74) *Attorney, Agent, or Firm*—Fleshner & Kim, LLP

(57) ABSTRACT

The present invention relates to an obturator for a refrigerator for cutting off heat or cool air transferred to and from a refrigerator. The present invention is comprised of a door gasket having an air bag that is transformed and rotated freely, and a projecting portion that is projected from at least one of the inner case and the refrigerator door liner, so that inflow of heat from outside or from a hot-line, into an inside of the refrigerator and leakage of the inside cool air of the refrigerator to the outside, are cut off or minimized and insulation performance is improved remarkably.

12 Claims, 12 Drawing Sheets

OBTURATOR FOR REFRIGERATOR

BACKGROUND OF THE INVENTION

1. Field of the Invention

The present invention relates to a refrigerator, and more particularly, to an obturator for a refrigerator for excluding heat or cool air that transfers to and from a refrigerator.

2. Description of the Related Art

Generally, a refrigerator discharges cool air generated by a freezing cycle comprising a compressor, a condenser, an expansion value, an evaporator, thereby lowering temperature for freezing or chilling foods. A refrigerator is equipped with a door gasket at a door liner, i.e., an inner edge of a refrigerator door for excluding heat flow into a refrigerator from outside as well as preventing cool air discharged to a refrigerator from leaking out to the outside.

FIG. 1 is a view showing a door of a conventional refrigerator. Referring to FIG. 1, a refrigerator door 10 is comprised of an outer door 20 made of iron plate, a door liner 30 for combining with the outer door 20 using ABS resin of predetermined shape manufactured by vacuum molding process, an urethane foaming member 40 manufactured by foam molding process, mounted between the outer door 20 and the door liner 30 for insulation. Here, in one side of the door liner 30 a door gasket for isolating an interior of a refrigerator from the outside, is mounted.

FIG. 2 is a view showing the door gasket mounted on a door liner of mullion part partitioning a freezer and a cool chamber in a conventional refrigerator door. Referring to FIG. 2, the conventional door gasket 50 is comprised of a sticking part 52 for sticking on an outer case 70 of a main body in a refrigerator with the help of magnetic force generated by installed magnet 51 within it; an air bag 53 formed at the bottom of the sticking part 52 as one body together with the sticking part and divided into many regions by partitions for making, at the bottom of the sticking part, predetermined spaces to which air could be instilled so as to alleviate impulse; a combining part 54 of an anchor shape, formed at the bottom of the air bag 53 as one body together with the air bag for fixing in a combining groove 31 of the door liner 30. Here, the air bag 53 is provided for alleviating impulses generated when the refrigerator door 10 is closed on the refrigerator's main body 60. Also, the outer case 70, preferably, may be made of magnetic material so that attractive force is exerted therebetween by the magnet 51.

When the refrigerator door 10 is closed onto a front surface of the refrigerator's main body 60, attractive force is exerted between the magnet 51 installed within the sticking part 52 and the outer case 70, so that the refrigerator door 10 get stuck on the main body 60, whereby an interior of the refrigerator is isolated from the outside.

In the meantime, when a user draws back the refrigerator door for separating the door 10 from the main body 60, drawing back force is exerted on the combining part 54 by the door liner 30 combined with the refrigerator door 10. Here, the tensile force transferred to the combining part 54 is, in sequence, directly delivered to the air bag 53 formed as one body with the combing part and then to the sticking part 52 formed as one body with the air bag. Accordingly, the sticking part 52 stuck on the refrigerator's main body 60 is separated from the outer case 70 of the main body, whereby a gap between the main body and the door of the refrigerator begins to open.

Lots of requirements are needed for the door gasket with consideration of refrigerator's characteristics. Particularly, among those requirements, insulation property which prevents cool air from leaking out to the outside and excludes heat flow from the outside by sealing the refrigerator door and main body closed, is strongly needed.

In the meantime, a lateral face of the refrigerator main body 60 is comprised of the outer case 70 constituting an outer wall of the refrigerator; an inner case 80 constituting an inner wall of the refrigerator; a hot-line 90 which is installed at the rear side of the outer case 70 for preventing dewdrop formation on the refrigerator's wall that would be generated by temperature difference between the inside and the outside of the refrigerator. Here, heat generated from the hot-line 90 may be transferred to the outer case 70 and, at the same time, this heat may flow into the interior of the refrigerator main body through an inner path A of the refrigerator, that is, through a gap between the inner case 80 and the door liner 30 of the refrigerator door.

Such heat transfer lowers cooling performance of the refrigerator itself much more, causing a problem that power dissipation increases accordingly. Also, a conventional door gasket 50 as shown in FIG. 2, in which the only sticking part 52 maintaining a predetermined width is stuck on the refrigerator main body 60, prevents outside heat or inside cool air from transferring to and from the refrigerator. Here, after long use of the door gasket, the sticking part 52 get worn out due to frequent opening of the refrigerator door and the sticking part 52 of the door gasket 50 may not be stuck on the outer case 70 of the refrigerator main body when the door 10 is closed on the refrigerator main body 60. Accordingly, closing is not made properly between the door 10 and the main body 6, so that the inside cool air may leak out to the outside of the refrigerator or the outside heat may flow into the inside of the refrigerator.

As is mentioned above, a problem is generated that the cooling performance of the refrigerator is lowered considerably in case that cool air leaks out or outside heat flows into the inside of the refrigerator due to incomplete closing between the refrigerator door and main body.

SUMMARY OF THE INVENTION

An object of the invention is to solve at least the above problems and/or disadvantages, and to provide at least the advantages described hereinafter.

Accordingly, one object of the invention is to provide an obturator for the refrigerator with improved insulation performance.

It is another object of the present invention to provide an obturator for the refrigerator for excluding heat penetration into the interior of the refrigerator by transforming an air bag structure in a door gasket.

It is still another object of the present invention to provide an obturator for the refrigerator for minimizing heat penetration into the interior of the refrigerator by forming projecting portion on at least one of door liner in the refrigerator door or an inner case of a refrigerator main body.

These and other objects and advantages of the invention are achieved by providing an obturator for the refrigerator comprising a door gasketinstalled on one side of a refrigerator door, having an air bag which could be transformed and rotated freely so that a gap between an inner case and a door liner is closed; a projecting portion formed on at least one of the inner case or the door liner so that the air bag blocks up the gap easily, is provided.

Preferably, an upper part of the air bag is thick in its thickness compared with its bottom. Also, preferably, a propping wall for maintaining a shape of the air bag, is provided on an inner face of the air bag and a first concave portion is formed on the one side of the bottom for free transformation and rotation of the air bag, and a second concave portion is formed on one side of an upper part of the air bag for separating the air bag from the sticking part.

The projecting portion may be formed on either a bottom of the inner case or the door liner. Also, the projecting portions may be formed on both the inner case and the door liner with the projecting portions faced opposite each other, and the projecting portions may be formed on above both parts with the projecting portions crossed each other.

According to another aspect of the invention, a door gasket for the refrigerator is provided, mounted on one side of the refrigerator door, and in which the air bag, transformed and rotated freely, is extended long from the lateral portion of the sticking part to the inner face of the refrigerator door, forming one body together with the sticking part. The air bag, preferably, sticks on closely between the inner case and the door liner when the refrigerator is closed.

According to further another aspect of the invention, an obturator for the refrigerator is provided, comprising a projecting portion formed on, at least one of the inner case or the door liner.

According to still another aspect of the invention, a door gasket for the refrigerator is provided, comprising the combining part that is fixed into the combining groove of the door liner; a first air bag that is formed as one body together with the combining part for alleviating impulse exerted upon contact of the refrigerator door and the refrigerator main body; a sticking part that is formed on the first air bag as one body for being stuck on the refrigerator main body by means of the magnet installed within it; a second air bag that is extended long from the lateral portion of the sticking part to the inner face of the refrigerator door, forming one body together with the sticking part, for being transformed and rotated freely.

Additional advantages, objects, and features of the invention will be set forth in part in the description which follows and in part will become apparent to those having ordinary skill in the art upon examination of the following or may be learned from practice of the invention. The objects and advantages of the invention may be realized and attained as particularly pointed out in the appended claims.

BRIEF DESCRIPTION OF THE DRAWINGS

The invention will be described in detail with reference to the following drawings in which like reference numerals refer to like elements wherein.

DETAILED DESCRIPTION OF THE PREFERRED EMBODIMENT

The following detailed description will present a preferred embodiment of the invention in reference to the accompanying drawings.

First Embodiment

Figure 1:
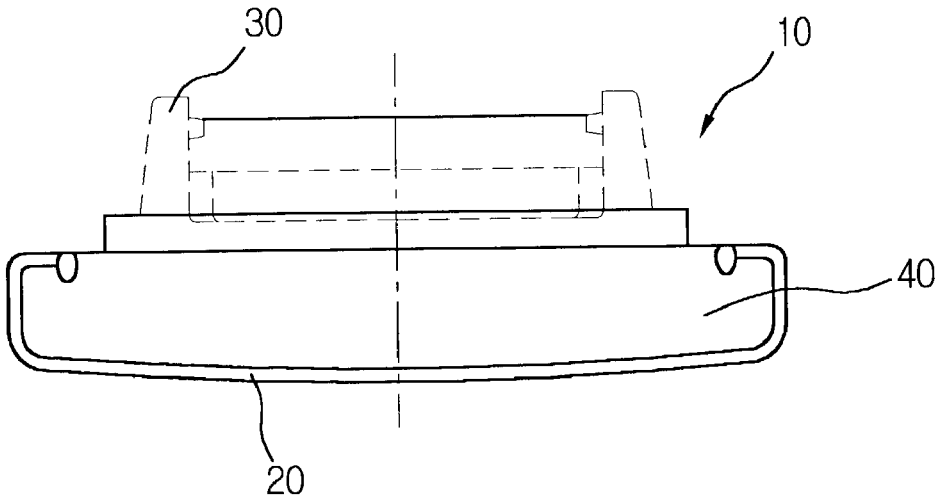
Fig. 1 (Related Art)
FIG. 1 illustrates the conventional refrigerator door.
Figure 2:
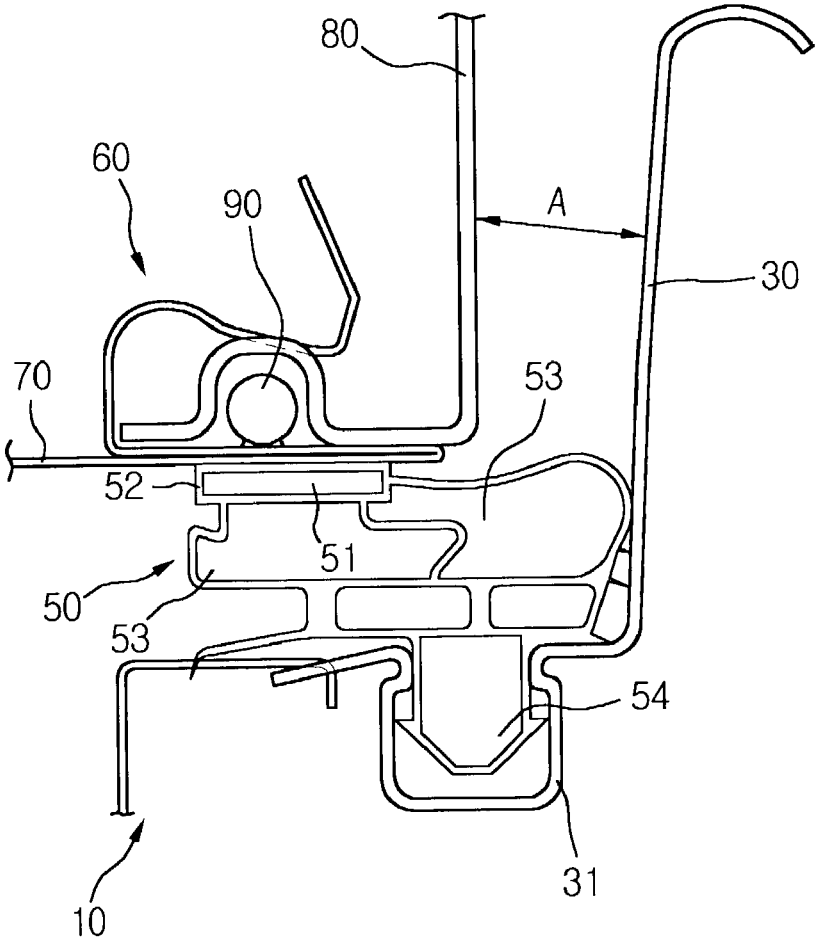
Fig. 2 (Related Art)
FIG. 2 illustrates a door gasket mounted on the door liner of the mullion part partitioning the freezer and the cool chamber in the refrigerator door.
Figure 3:
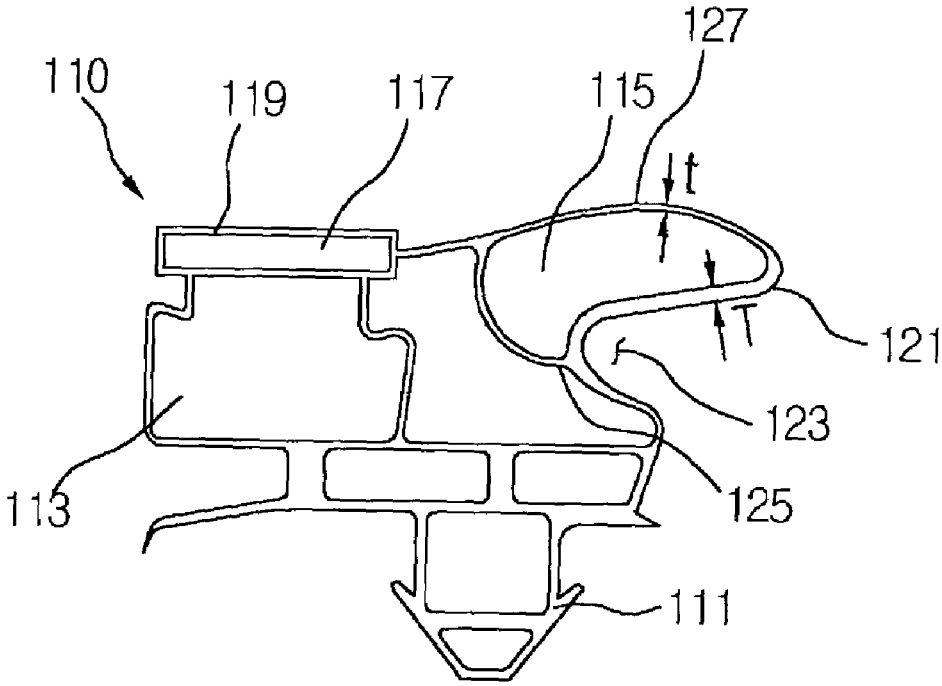
FIG. 3 illustrates a door gasket of the refrigerator in accordance with a preferred embodiment of the present invention.

The first embodiment of the present invention relates to transformation of the air bag of the door gasket mounted and fixed on the refrigerator door, thereby closing the gap between the inside and outside of the refrigerator. FIG. 3 is a drawing illustrating the door gasket of the refrigerator according to a preferred embodiment of the present invention. Referring to FIG. 3, the door gasket 110 of the present invention is comprised of the combining part 111 inserted and fixed in the combining groove 31 of the door liner 30; the first air bag 113 formed as one body together with the combining part 111, for alleviating impulse exerted upon contact of the refrigerator door 10 and the refrigerator main body 60; the sticking part 119 formed on the first air bag 113 as one body together with it, for being stuck on the refrigerator main body 60 by means of the magnet 117 inserted within it; and the second air bag extended long from the lateral portion of the sticking part 119 to the inner face of the refrigerator door 10, forming one body together with the sticking part, for being transformed and rotated freely.

The combining part 111 is of anchor shape for easy insertion and the combining part is firmly inserted and fixed in the combining groove 31 of the door liner so that detachment of the combining part 111 is difficult. The first air bag 113 is for alleviating impulse exerted when the refrigerator door is closed on the refrigerator main body 60 and for preventing the refrigerator door from recoiling to an opposite direction due to the impulse, whereby the sticking part 119 within which the magnet 117 is installed, is stuck on the outer case 70 of the refrigerator main body 60.

The second air bag 115, which is a core part of the present invention, is extended long to the door liner 30 sides in the refrigerator door 10. Here, the second air bag 115 has, preferably, the upper part 127 whose thickness T is thin in its thickness compared with a thickness T of the bottom part 121 of the second air bag. By making the upper part of the second air bag thin in its thickness, the second air bag may be pushed easily by the refrigerator main body 60 upon contact with the main body. Also, by making the bottom of the second air bag thick in its thickness, the second air bag may not be pushed more than a predetermined extent upon contact with the refrigerator main body, maintaining its shape.

On one side in the bottom of the second air bag, the first concave portion 123 for free transformation and rotation of the second air bag 115 is formed. Accordingly, the second air bag may be transformed or rotated freely upon contact with the refrigerator main body 60 thanks to the first concave portion 123. Namely, the second air bag 115 may be bent easily by means of the first concave portion 123.

On the second air bag, a propping wall 125 for preventing the second air bag from hanging down at ordinary times and maintaining its shape more firmly, may be provided to its inner face.

As the magnet is installed within the sticking part 119, the refrigerator door 10 is stuck on the refrigerator main body 60. In case of applying the second air bag 115 of the door gasket 110 described above, there may be generated a problem that when the door is closed, the second air bag is pushed by the inner case, with the sticking part 119 opened accordingly, whereby closing on the main body is not performed well. In order to resolve this problem, the second air bag of the door gasket 110 may be transformed in its structure as shown in FIG. 4.

Figure 4:
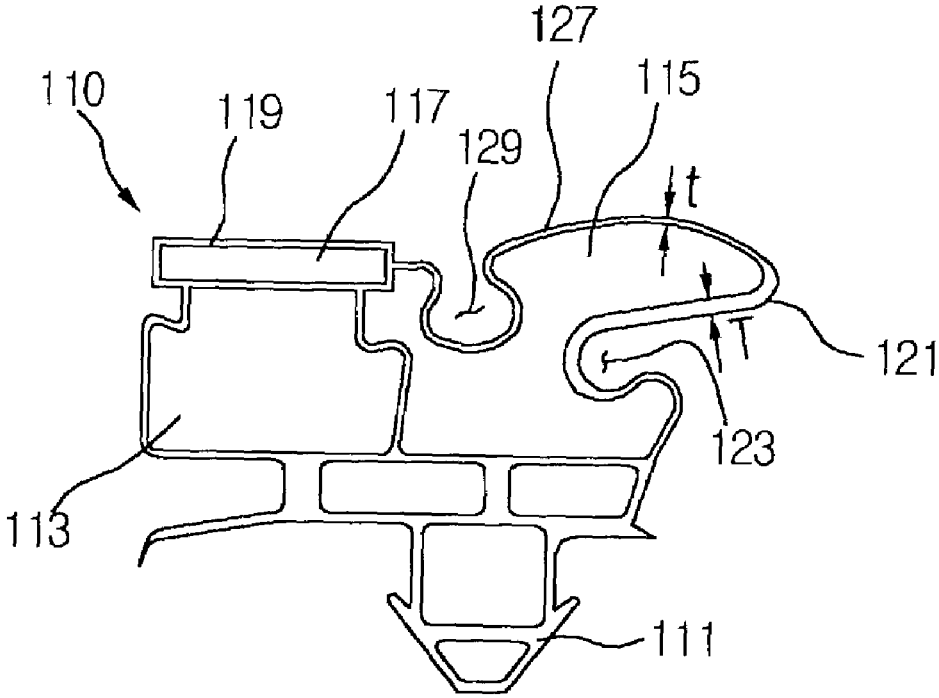
FIG. 4 illustrates a door gasket of the refrigerator in accordance with another preferred embodiment of the present invention.

FIG. 4 is a drawing illustrating the door gasket of the refrigerator according to another preferred embodiment of the present invention. Referring to FIG. 4, the second air bag 115 has the second concave portion 129 on one side of its upper portion 127 so that the sticking part 119 may not push the air bag. By the second concave portion 129, the sticking part 119 is spaced from the second air bag and even in case that the second air bag is pushed, such pushing has no influence on the sticking part 119. Accordingly, thanks to formation of the second concave portion 129, the sticking part 119 maintains its sticking on the main body regardless of pushing of the second air bag 115. In short, the second concave portion 129 is formed for independent transformations of the sticking part 119 and the second air bag 115.

Application of the door gasket of the refrigerator mentioned above to the refrigerator door will be described herein below with reference to FIG. 5 through FIG. 8.

Figure 5:
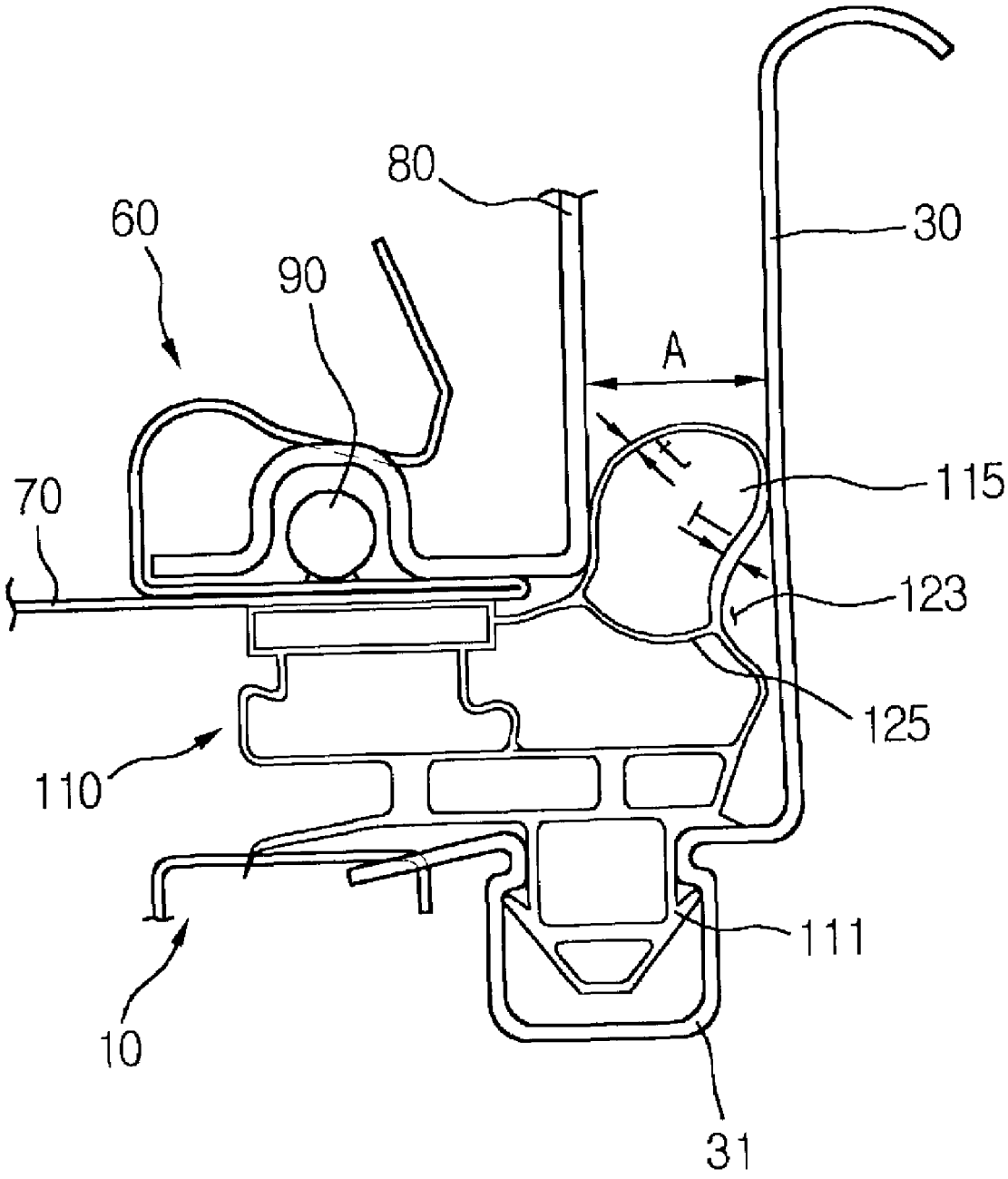
FIG. 5 illustrates an application of the door gasket to the door contact part, i.e., the mullion part consisting of the freezer and the cool chamber in the refrigerator in accordance with a preferred embodiment of the present invention.
Figure 7:
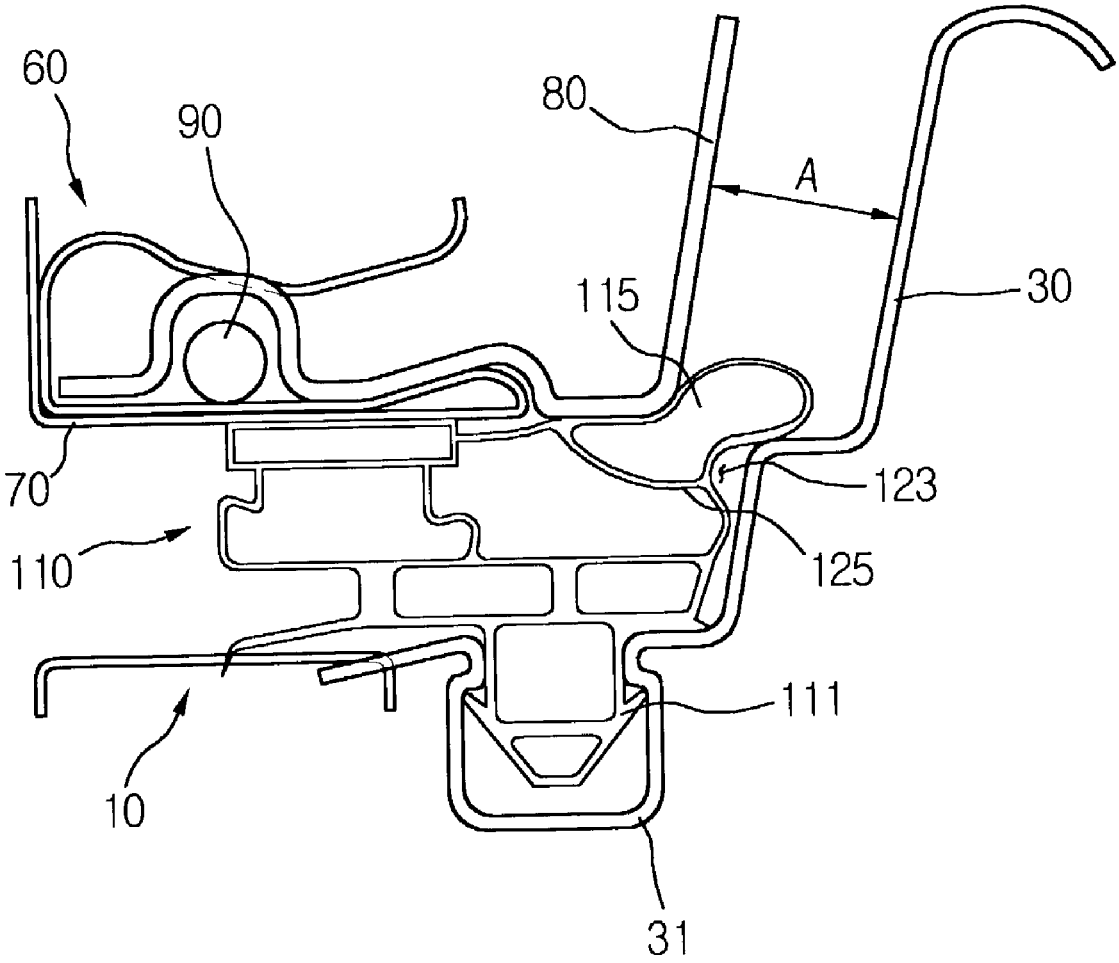
FIG. 7 illustrates an application of a door gasket to the outer door contact part, i.e., the case flange part of the refrigerator in accordance with a preferred embodiment of the present invention.

FIG. 5 and FIG. 7 are drawings illustrating applications of the door gasket of the refrigerator to the door contact part (mullion part) consisting of the freezer and the cool chamber of the refrigerator, and to the outer door contact part (case-flange part) of the refrigerator, respectively, in accordance with a preferred embodiment of the present invention. Referring to FIG. 5 and FIG. 7, in case that the refrigerator door 10 on which the door gasket of the refrigerator according to a preferred embodiment of the present invention is mounted and fixed, is closed on the refrigerator main body 60, the second air bag blocks up the internal path, i.e., the gap between the inner case 80 of the refrigerator main body 60 and the door liner 30 of the refrigerator door 10. Here, the second air bag 115 is transformed or rotated up and down freely thanks to the first concave portion 123 though the internal path A is different in its structure.

Figure 6:
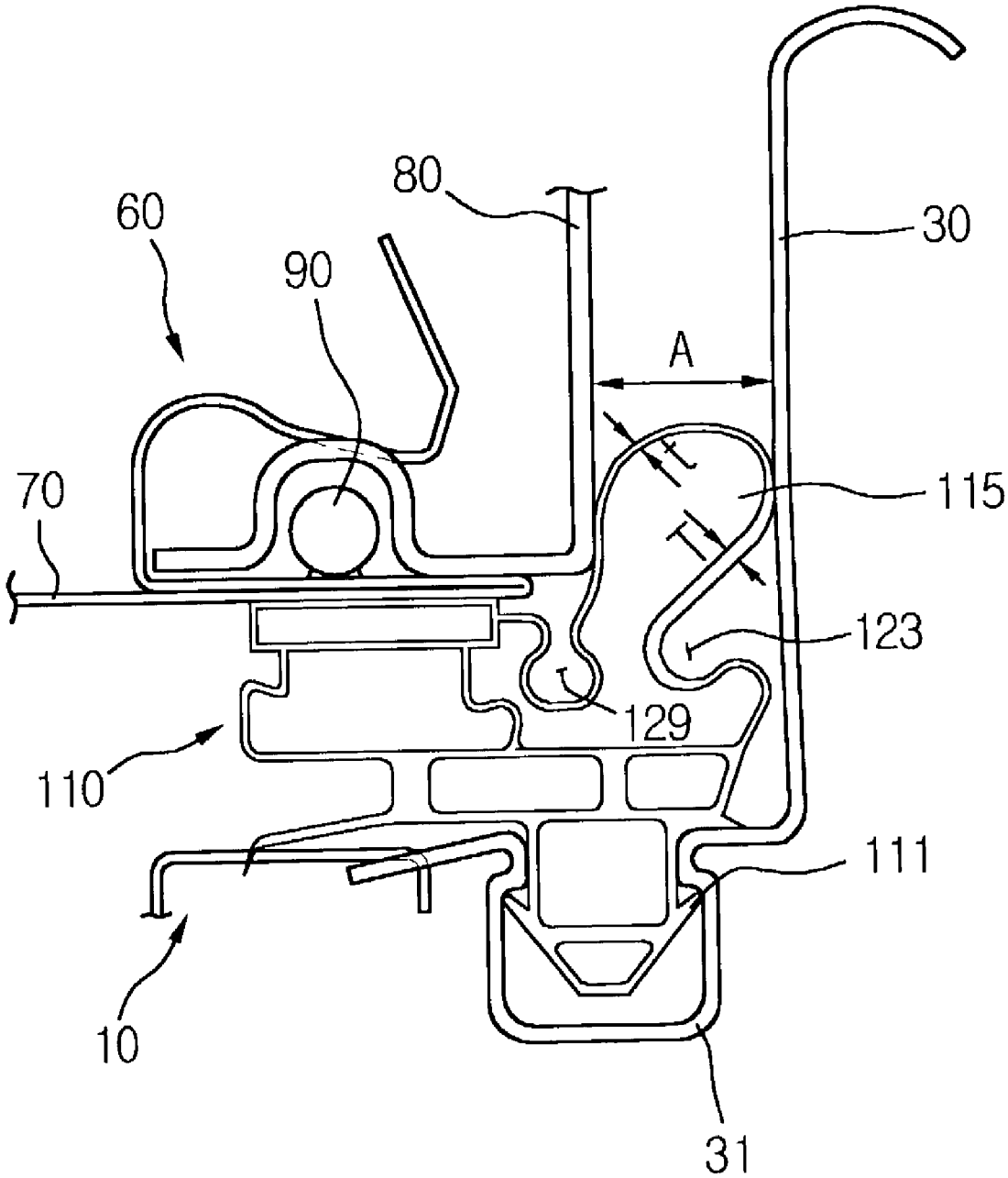
FIG. 6 is illustrates an application of a door gasket to the door contact part, i.e., the mullion part consisting of the freezer and the cool chamber in the refrigerator in accordance with another preferred embodiment of the present invention.
Figure 8:
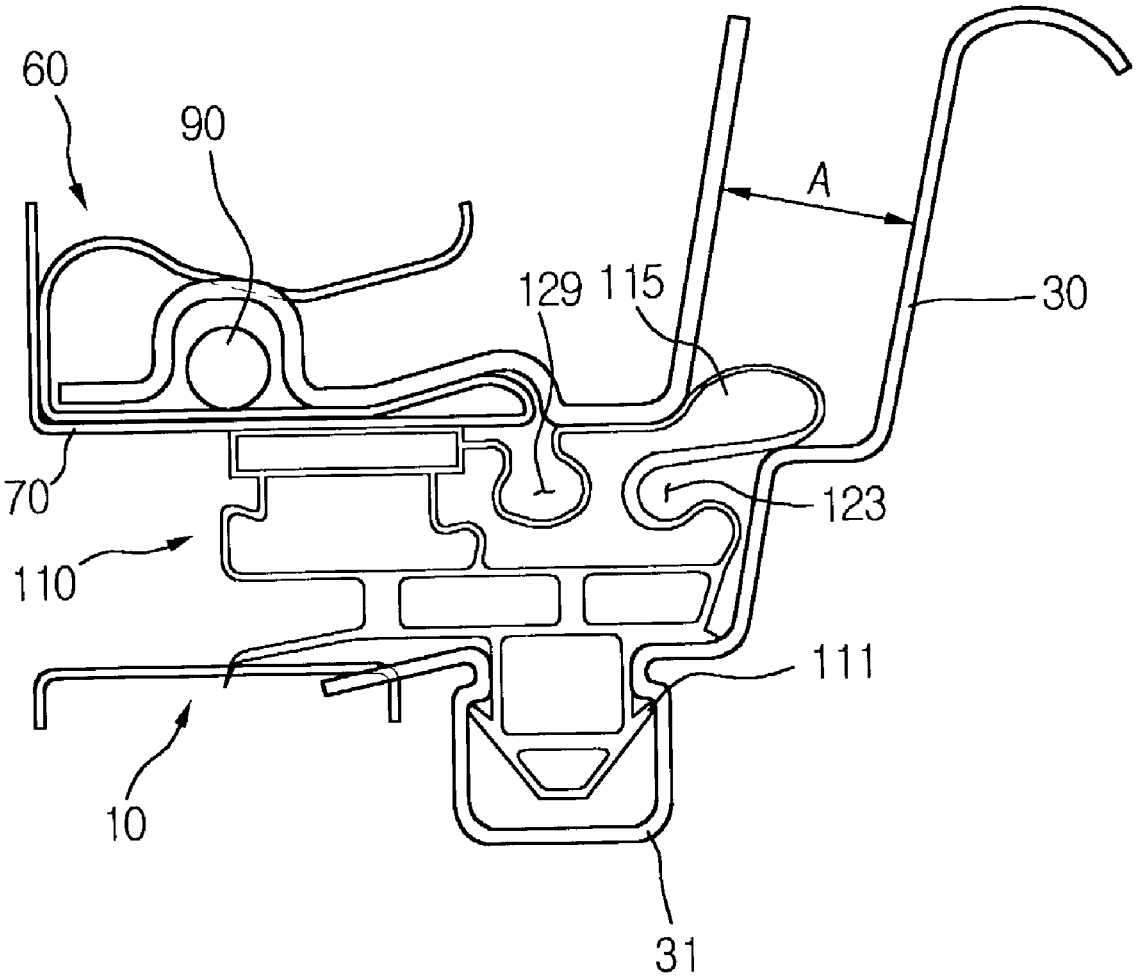
FIG. 8 illustrates an application of a door gasket to the outer door contact part, i.e., the case flange part of the refrigerator in accordance with another preferred embodiment of the present invention.

FIG. 6 and FIG. 8 are drawings illustrating application of the door gasket of the refrigerator to the door contact part (mullion part) consisting of the freezer and the cool chamber of the refrigerator, and to the outer door contact part (case flange part) of the refrigerator, respectively, in accordance with another preferred embodiment of the present invention. As is shown in FIG. 6 and FIG. 8, in case that the refrigerator door 10 is closed, the second air bag blocks up the internal path, i.e., the gap between the inner case 80 of the refrigerator main body 60 and the door liner 30 of the refrigerator door 10. Also, the second air bag has the second concave portion 129 on one side of its portion, so that a problem that the second air bag is transformed due to the sticking part 119 and the internal path A is not blocked up properly, is prevented in advance though the sticking part 119 is worn out and pushed to the side of the second air bag. Furthermore, thanks to formation of the second concave portion 129 the second air bag may move to right and left freely.

Second Embodiment

The second embodiment of the present invention relates to minimization of the gap between the inner case of the refrigerator main body and the door liner of the refrigerator door and to lengthening of a heat transfer path that passes through a inner case ABS resin and a door liner wall, thereby restraining cool air or heat transfer moving to and from the refrigerator.

Figure 9:
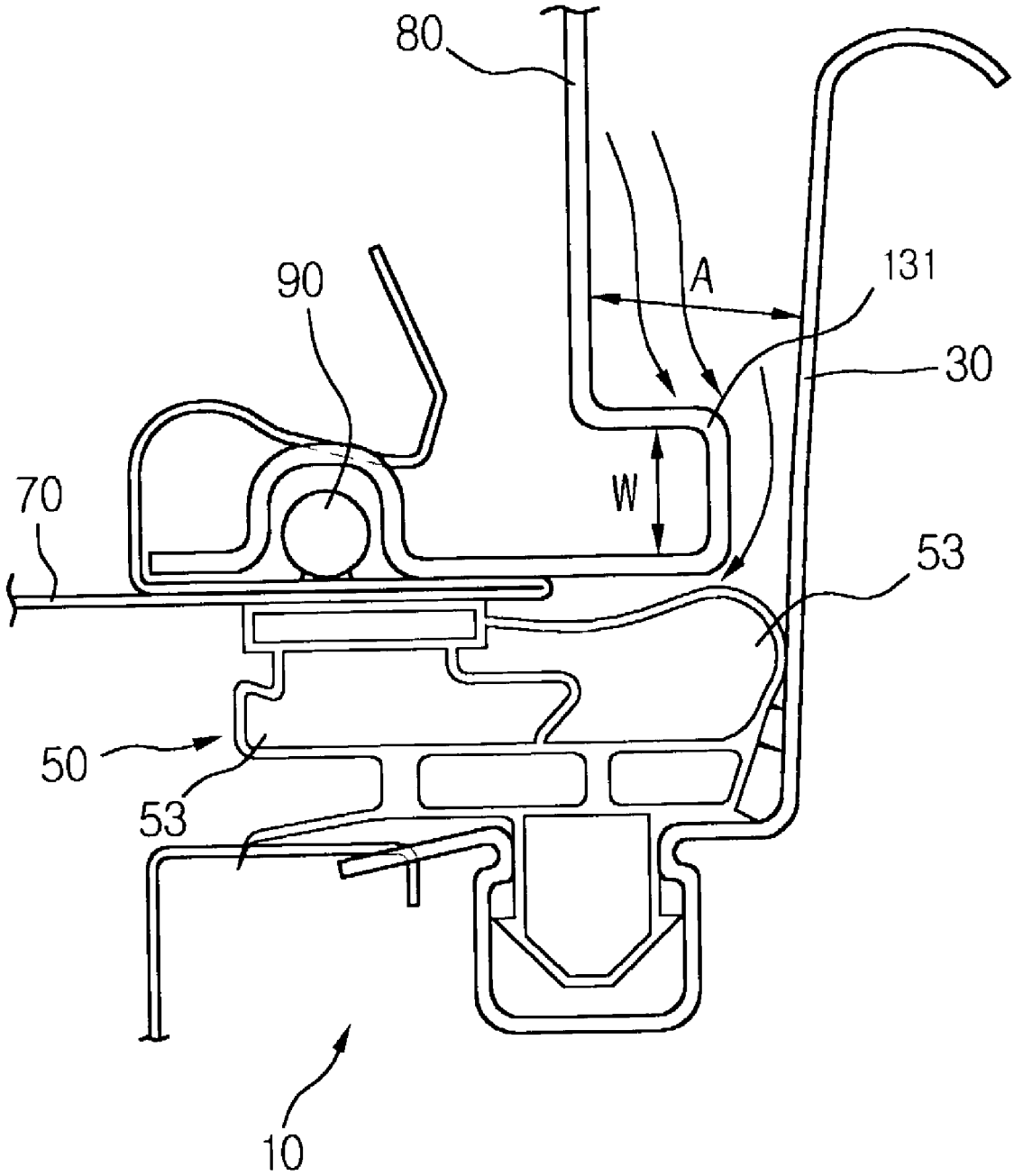
FIG. 9 illustrates the transformed inner case structure of the refrigerator main body in an obturator for the refrigerator in accordance with another preferred embodiment of the present invention.

As illustrated in FIG. 9, a structure which narrows the internal path A is achieved by forming the projecting portion 131 projected to a side of the refrigerator door liner, on one side of the inner case 80 of the refrigerator main body 60. Here, the projecting portion 131 may be formed on anywhere on one side of the inner case.

Figure 10:
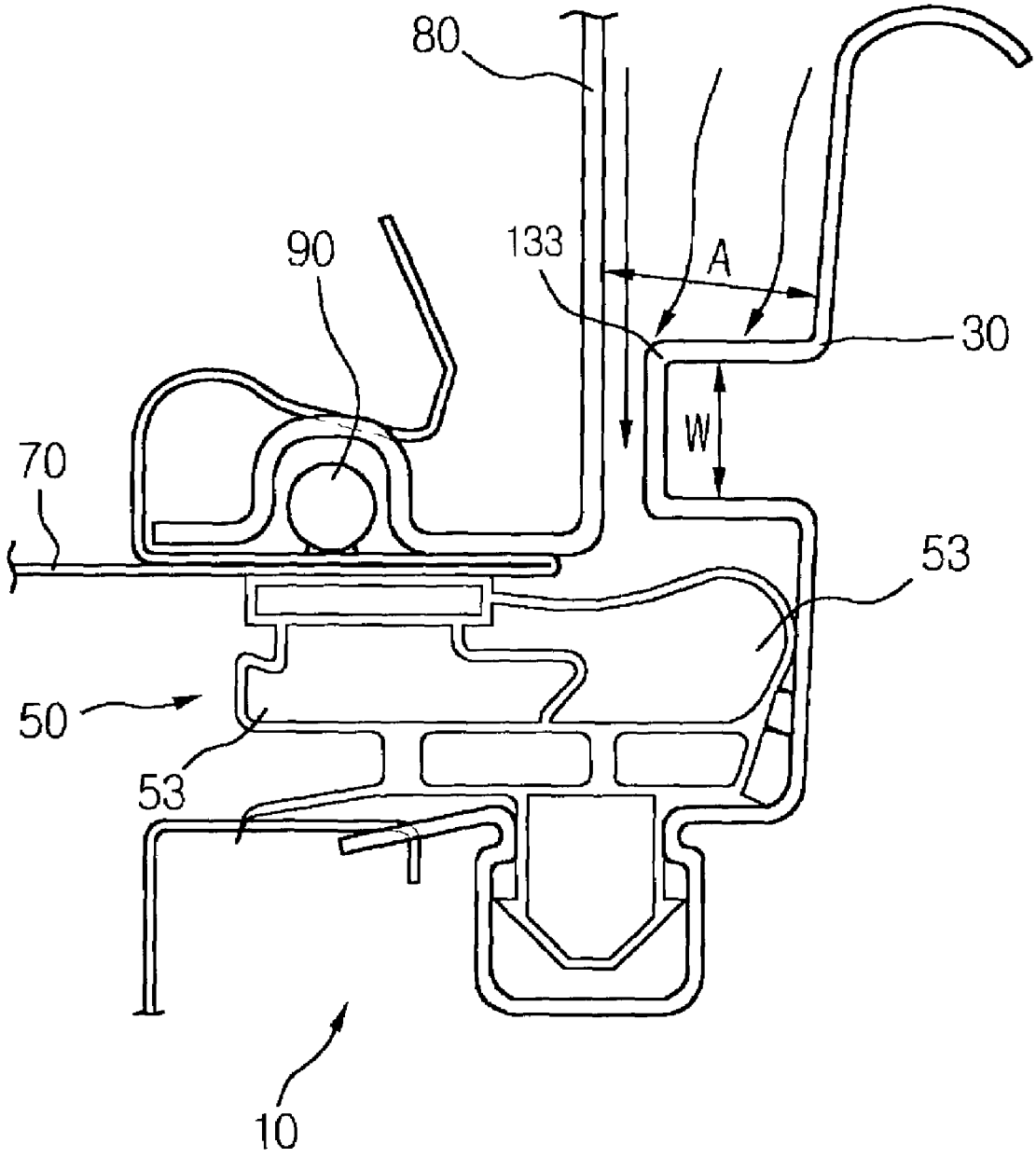
FIG. 10 illustrates the transformed door liner structure of the refrigerator door in an obturator for the refrigerator in accordance with another preferred embodiment of the present invention.

As illustrated in FIG. 10, another structure which narrows the internal path A may also be achieved by projecting the door liner 30 of the refrigerator door 10. Namely, the projecting portion 133 projected to a side of the inner case 80, is formed on one side of the door liner 30.

Figure 11:
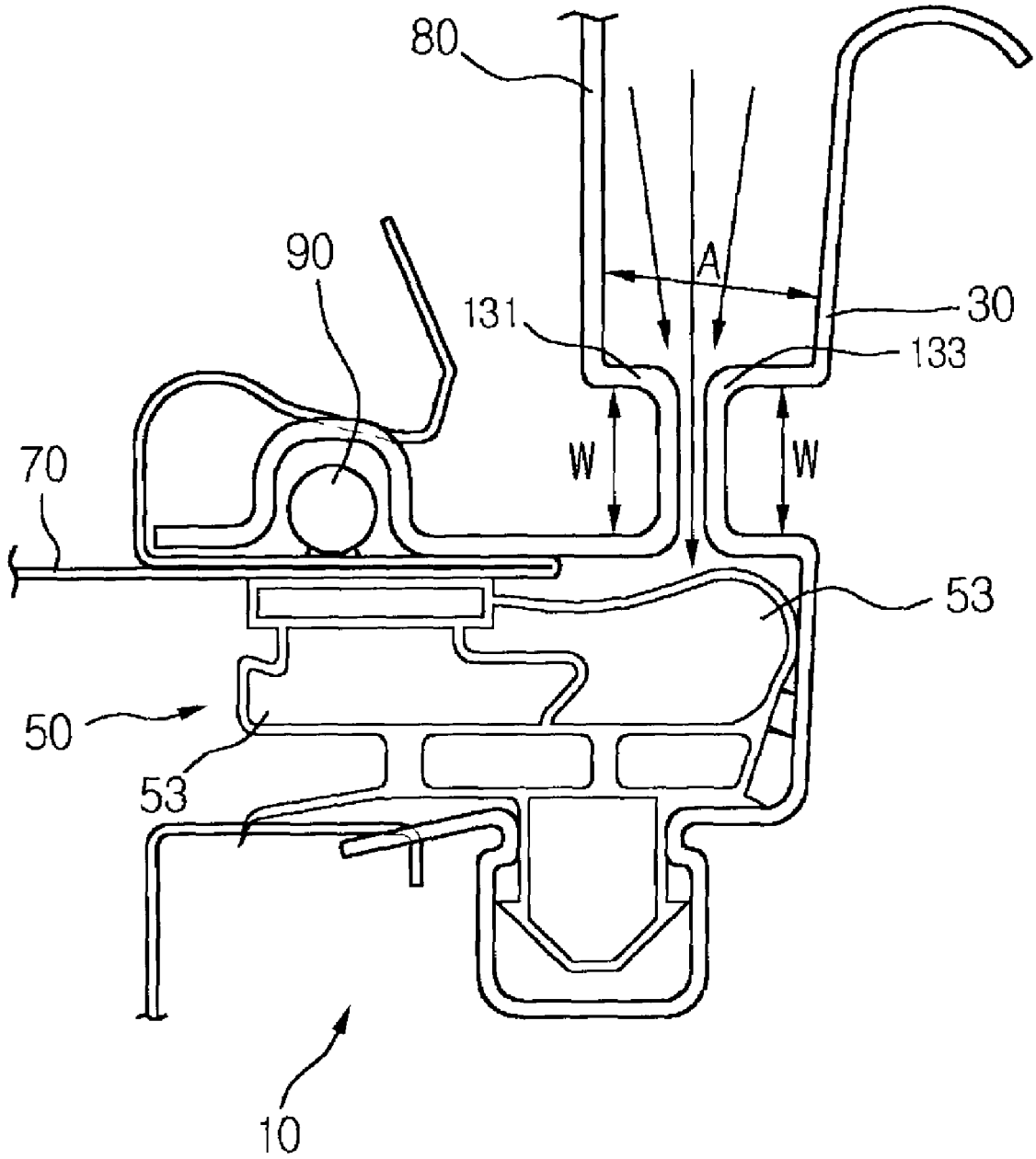
FIG. 11 and FIG. 12 illustrate a structure in which both the inner case of the refrigerator main body and the door liner of the refrigerator door are transformed in an obturator for the refrigerator in accordance with another preferred embodiment of the present invention.

As illustrated in FIG. 11, further another structure which narrows the internal path A may also be achieved by forming projection portions 131 and 133 such that each projecting portion is projected both from the inner case 80 and the door liner 30, respectively, with each projecting portion faced opposite each other.

Figure 12:
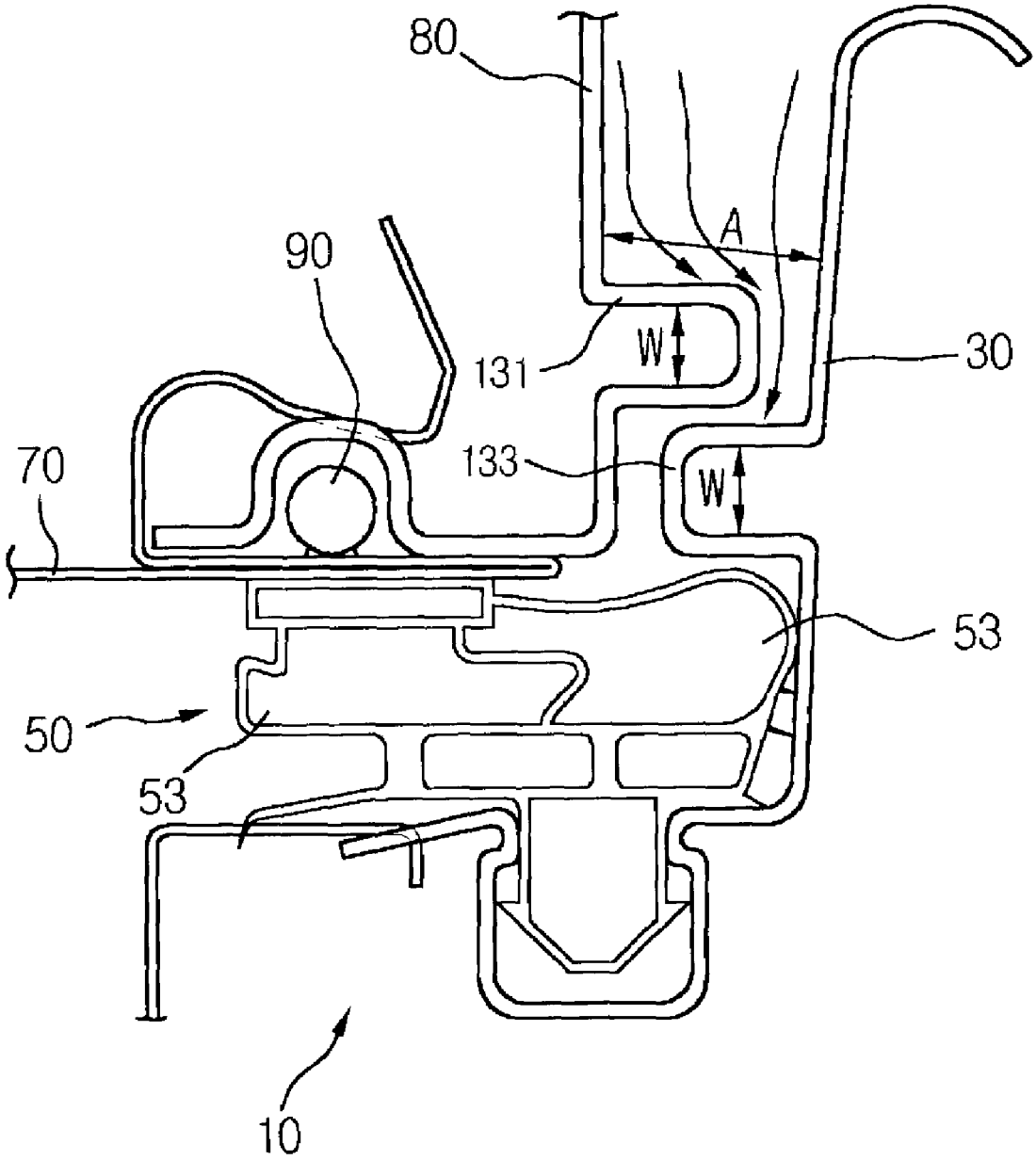

As illustrated in FIG. 12, still further another structure which narrows the internal path A may also be achieved by forming projection portions 131 and 133 such that each projecting portion is projected both from the inner case 80 and the door liner 30, respectively, with each projecting portion crossed each other.

As illustrated in FIG. 11 and FIG. 12, the projecting portions 131 and 133 may be formed so that each projecting portion both from the inner case 80 and the door liner 30 is faced opposite or crossed each other, whereby heat or cool air can be cut off more effectively.

In FIG. 9 through FIG. 12, the projecting portions 131 and 133 are preferably formed wide in its width W for increasing a heat transfer resistance regarding the heat or the cool air that passes through the internal path A. Also, in FIG. 9 through FIG. 12, the projecting portions 131 and 133 are preferably formed close to the side of the door liner 30 of the refrigerator door 10 so that the internal path A is formed narrow as much as possible. Of course, the projecting portions 131 and 133 should be formed so that they may not be barred by the door liner 30 when the refrigerator door is closed on the refrigerator main body.

The projecting portions 131 and 133 formed in FIG. 9 through FIG. 12, can be manufactured simply upon formation of the inner case 80 and the door liner 30 and also they can be formed on an invisible portion. Accordingly, appearance of the refrigerator is not spoiled very much while heat or cool air can be cut off effectively.

Third Embodiment

A third embodiment of the present invention relates to more definite obturation of the inside and outside of the refrigerator by applying the first embodiment and the second embodiment. Namely, the third embodiment blocks up the internal path A using the second air bag of the door gasket, making the internal path narrow using the projecting portion, thereby cutting off heat or cool air completely, improving cooling performance to the maximum extent.

Figure 13:
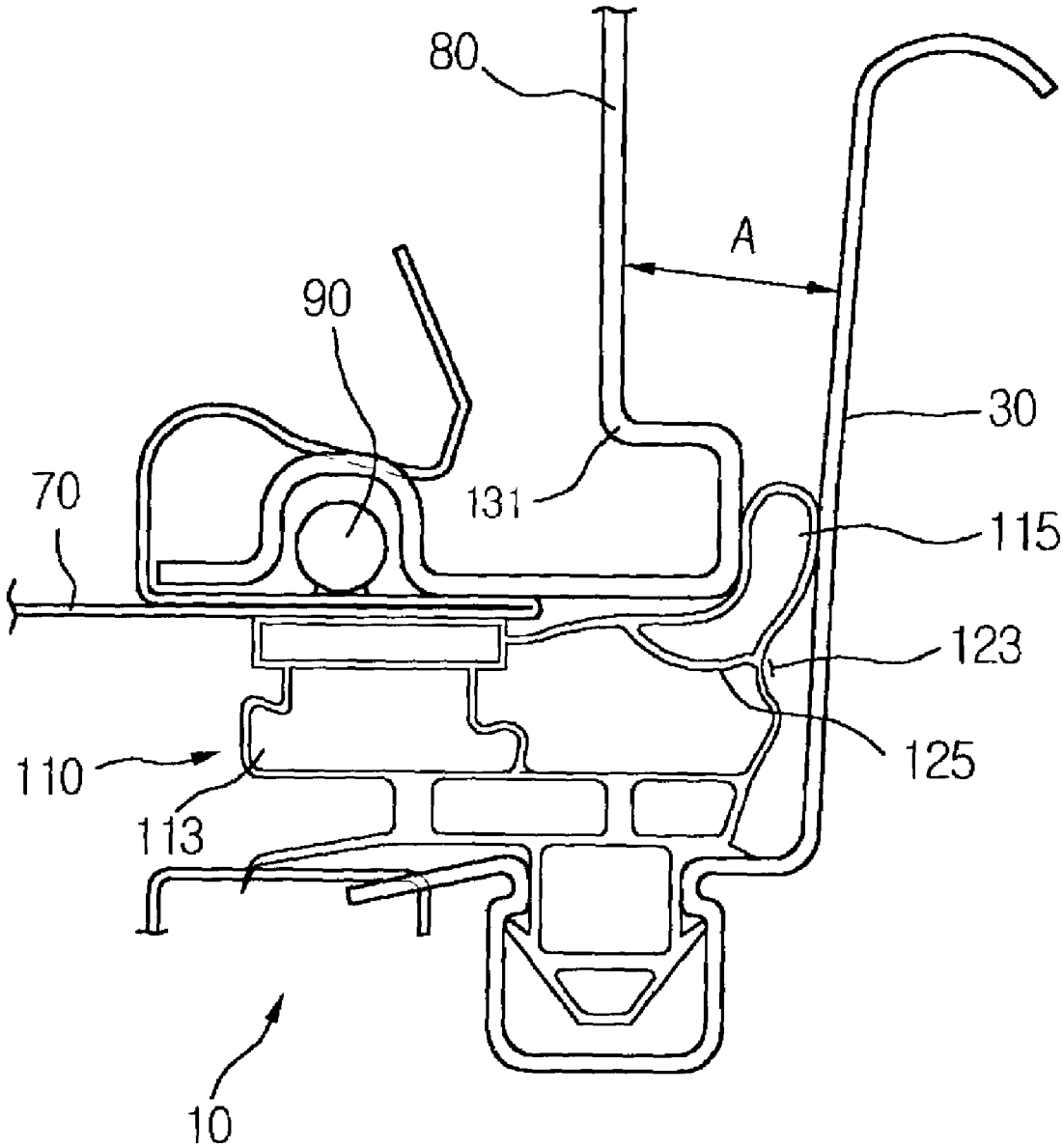
FIG. 13 and FIG. 14 illustrate an application of the door gasket to the door contact part, i.e., the mullion part consisting of the freezer and the cool chamber in the refrigerator, and a structure in which the internal path of the refrigerator is transformed.
Figure 14:
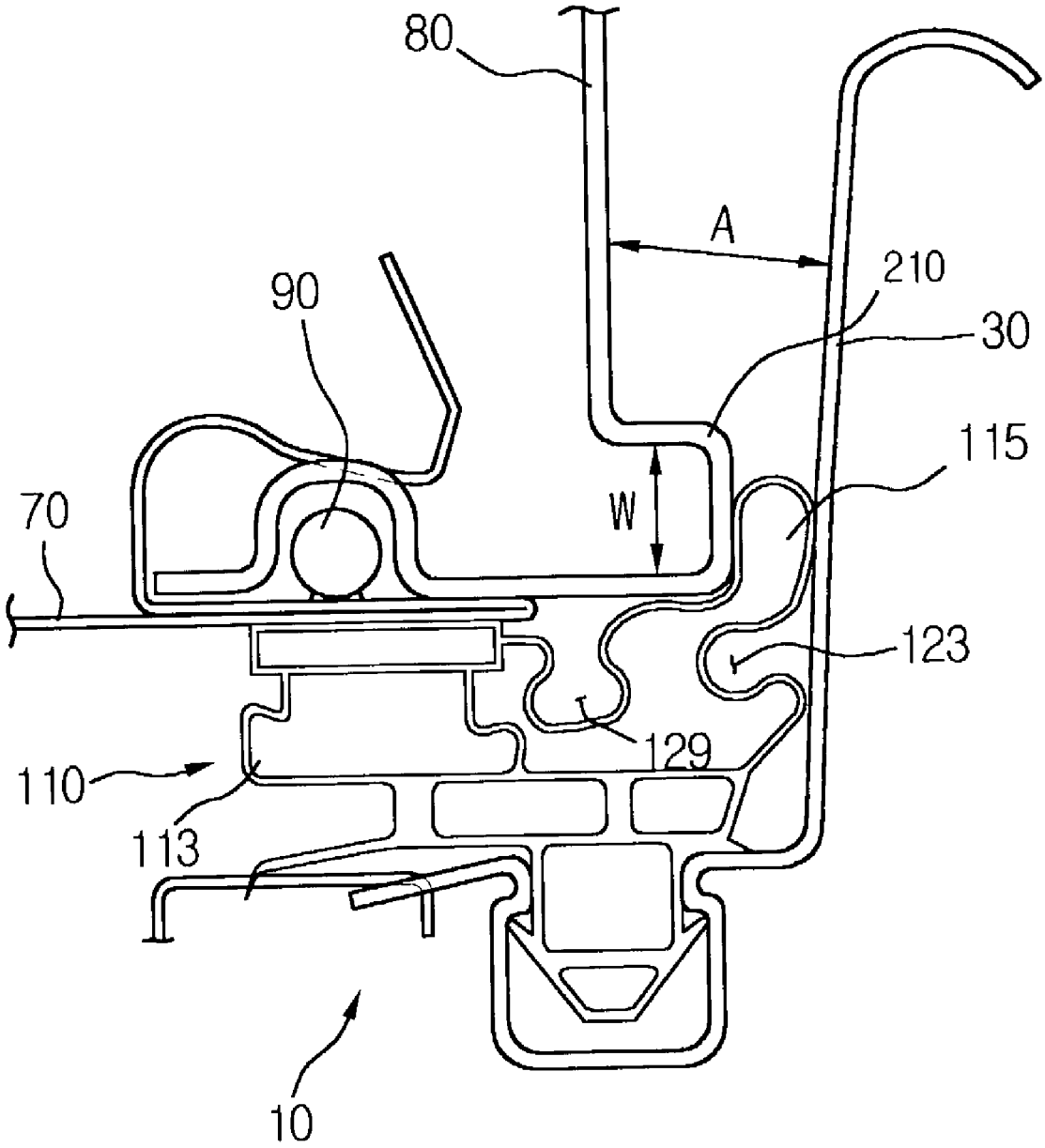

FIG. 13 and FIG. 14 are drawings illustrating a transformed structure for the internal path of the refrigerator with application of the door gasket according to a preferred embodiment of the present invention, to the door contact part (mullion part) consisting of the freezer and the cool chamber of the refrigerator.

As illustrated in FIG. 13 and FIG. 14, the second air bag 115 is extended long to the side of the door liner 30; and at the same time, the door gasket 110 on which the first concave portion 123 for free transformation and rotation of the air bag and the second concave portion 129 for separating the sticking part 119 from the second air bag 115 are formed respectively; and the projecting portions 131 and 133 for narrowing the internal path A, are provided together to the door 10 and main body 60 of the refrigerator. Accordingly, a first obturation is made by the second air bag 115 and, simultaneously, a second obturation is made by the projecting portions 131 and 133 for narrowing the internal path, so that complete obturation is accomplished, cooling performance is improved to the maximum extent, and power dissipation is lowered very much accordingly.

Here, in order that the second air bag 115 blocks up the internal path, the projecting portions 131and 133 are preferably formed on the bottom of the inner case 80 or the door liner 30, more exactly, on a portion, predetermined part of which is overlapped by the second air bag 115 when the door 10 is closed.

In the foregoing, though the third embodiment is described with a limited application of the door gasket to the mullion part, it is needless to say that the third embodiment can be applied to the case-flange part, i.e., a lateral part consisting of the freezer and the cool chamber.

As is apparent from the above descriptions, according to the obturator for the refrigerator of the present invention, the internal path is blocked up by transformation of the air bag in the door gasket, whereby inflow of heat from the outside or from the hot-line into the inside of the refrigerator and leakage of the inside cool air of the refrigerator out to the outside, are cut off and cooling performance is improved accordingly.

Furthermore, according to the obturator for the refrigerator of the present invention, projecting portion is formed on either the inner case or door liner for narrowing the internal path, whereby the heat transfer resistance regarding the inside cool air or the outside heat of the refrigerator is increased to the maximum extent and cooling performance is improved accordingly.

Also, according to the obturator for the refrigerator of the present invention, though the sticking part of the door gasket get old and worn out, the air bag blocks up the internal path of the refrigerator secondly, thereby cutting off the heat transfer generated from the hot-line as well as cutting off completely the heat transfer or cool air transfer to and from the refrigerator, improving insulation performance remarkably and lowering power dissipation of the refrigerator very much accordingly.

Therefore, according to the obturator for the refrigerator of the present invention, as transformations of the air bag in the door gasket and of projecting portion for narrowing the internal path are made simultaneously, completed obturation is achieved, whereby it is expected that cooling performance is improved to the maximum extent while power dissipation is lowered considerably.

The foregoing embodiments and advantages are merely exemplary and are not to be construed as limiting the present invention. The present teaching can be readily applied to other types of apparatuses. The description of the invention is intended to be illustrative, and not to limit the scope of the claims. Many alternatives, modifications, and variations will be apparent to those skilled in the art.

What is claimed is:

1. An obturator of a refrigerator having a refrigerator main body with an outer case and an inner case constituting an outer wall and an inner wall in the refrigerator, respectively, and a refrigerator door, which is opened and closed on the refrigerator main body and on which a door liner is provided opposite to the inner case, the obturator comprising:

a door gasket for the refrigerator, wherein the door gasket includes a transformable and freely rotatable air bag that is configured to be mounted on one side of the refrigerator door of the refrigerator, wherein the air bag is configured to extend from a lateral portion of a sticking part to an inner face of the refrigerator door, where the airbag and the sticking part form one body, wherein the inner case includes a first surface corresponding to a surface contacting the outer case, and a second surface bent from the first surface, and wherein at least one portion of the air bag is configured to be accommodated in a predetermined gap defined between the second surface and the door liner of the refrigerator door so as to block up the predetermined gap.

2. The obturator of a refrigerator according to claim 1, wherein the air bag blocks up the predetermined gap between the second surface and the door liner when the refrigerator door is closed.

3. The obturator of a refrigerator according to claim 1, wherein an upper portion of the air bag is thin in a thickness of the air bag compared with a bottom of the air bag.

4. The obturator of a refrigerator according to claim 1, wherein a propping wall is equipped for maintaining a shape on an inner face of the air bag.

5. The obturator of a refrigerator according to claim 1, wherein a concave portion is formed for free transformation and rotation of the air bag on one side of a bottom of the air bag.

6. The obturator of a refrigerator according to claim 1, wherein a concave portion is formed for separation of the air bag from the sticking part on one side of an upper portion of the air bag.

7. An obturator of a refrigerator having a refrigerator main body with an outer case and an inner case, respectively, constituting an outer wall and an inner wall of the refrigerator main body, and a refrigerator door which is opened and closed on the refrigerator and which has a door liner provided on a mullion part to oppose the inner case, the inner case and the door liner defining a space, the obturator comprising:

a door gasket, comprising:

a first air bag; and a second air bag, wherein the second air bag is positioned laterally of the first air bag, wherein the inner case includes a first surface corresponding to a surface contacting the outer case, and a second surface bent from the first surface, and wherein the first air bag is configured to contact only the outer case of the refrigerator main body while the second air bag is configured to contact only the second surface when accommodated in the space, wherein a concave portion is formed on one side of the second air bag which faces the door liner, and wherein only an upper part of the concave portion of the second airbag is accommodated in the space.

8. The obturator of claim 7, further comprising a sticking part attached to the first air bag so that the sticking part sticks to only the outer case.

9. The obturator of claim 7, wherein the portion of the bag with the concave portion is thicker than the portion of the bag without the concave portion.

10. An obturator of a refrigerator having a refrigerator main body with an outer case and an inner case, respectively, constituting an outer wall and an inner wall of the refrigerator main body, and a refrigerator door having a door liner on a mullion part opposing the inner case, the inner case and the door liner defining a space, the obturator comprising:

a first air bag; and a second air bag, wherein the first and second air bags are formed as one body, wherein the inner case includes a first surface corresponding to a surface contacting the outer case, and a second surface bent from the first surface, and wherein a concave portion is formed on one side of the second air bag which faces the door liner, and wherein only an upper part of the concave portion of the second air bag is seated in the space defined between the second surface and the door liner to block the space.

11. The obturator of claim 10, further comprising a sticking part attached to the first air bag so that the sticking part sticks to only the outer case.

12. The obturator of claim 10, wherein a portion of the bag with the concave portion is thicker than a portion of the bag without the concave portion.

* * * * *